US006520865B1

(12) United States Patent
Fioretti

(10) Patent No.: US 6,520,865 B1
(45) Date of Patent: Feb. 18, 2003

(54) GOLF CLUB PUTTER HEAD DESIGN

(76) Inventor: Donald W. Fioretti, 414 Wintergreen Ave., Hamden, CT (US) 06514

( * ) Notice: Subject to any disclaimer, the term of this patent is extended or adjusted under 35 U.S.C. 154(b) by 0 days.

(21) Appl. No.: 09/931,443

(22) Filed: Aug. 16, 2001

(51) Int. Cl.[7] ..... A63B 69/36; A63B 53/04
(52) U.S. Cl. ..... 473/251; 473/330; 473/340
(58) Field of Search ..... 473/236, 330, 473/331, 340, 341, 251, 313, 219, 325, 280; D21/736, 737, 738

(56) References Cited

U.S. PATENT DOCUMENTS 1,467,714 A * 9/1923 Doerr
1,678,750 A * 7/1928 Swan
2,472,978 A * 6/1949 Mahon
2,829,417 A * 3/1958 Marcoccio
3,333,854 A * 8/1967 White
3,881,733 A * 5/1975 Csernits
4,165,076 A * 8/1979 Cella
4,201,384 A * 5/1980 Barber
4,290,606 A * 9/1981 Maxwell
4,846,477 A * 7/1989 Phelan
5,135,228 A * 8/1992 Hawkins
5,467,987 A * 11/1995 Perkins
5,830,075 A * 11/1998 Hirose
6,045,452 A * 4/2000 Ahn
6,099,413 A * 8/2000 Naylor
6,264,571 B1 7/2001 Lekavich
6,267,690 B1 * 7/2001 Salmon

* cited by examiner

*Primary Examiner*—Sebastiano Passaniti
(74) *Attorney, Agent, or Firm*—DeLio & Peterson, LLC

(57) ABSTRACT

A golf putter is provided which has a vertical arcuate striking face wherein the height of the striking face is at least as high as the diameter of a golf ball. The arcuate face is preferably in the shape of the contour of a golf ball and upon contact of the striking face with the golf ball, the golf ball is propelled straight along its intended path. The putter head has a top surface with a top front edge, a bottom surface with a bottom front edge, rear and opposing edge faces and a vertical arcuate striking face extending from the bottom front edge to the top front edge so that the top front edge overhangs the bottom front edge.

4 Claims, 2 Drawing Sheets

GOLF CLUB PUTTER HEAD DESIGN

BACKGROUND OF THE INVENTION

1. Field of the Invention

This invention relates to golf clubs, and in particular, to golf club putters having a putter head which utilizes an arcuate surface across the face of the putter head to facilitate the striking of the golf ball by the golfer during play on the putting surface.

2. Description of Related Art

The putting stroke by a golfer involves striking the spherical golf ball with a golf club commonly referred to as a putter, to cause the golf ball to roll over the putting surface with more accuracy than the other golf clubs. While golfers use various putting techniques to cause the ball to move accurately over the putting surface, they also employ many types of golf club putters with a myriad of putter head designs to facilitate the putting technique. The putter head of any golf putter is usually connected directly to a shaft which terminates in a handle which is held in the hands of the golfer. In some designs, the putter head is connected to a hosel which then is connected to the shaft of the putter which ultimately terminates in the handle. The materials and compositions of the putter head are chosen to give a putter a different feel or sensation when the golfer strikes the golf ball at the face of the putter head. Older putter heads were made of wood and were connected to the putter handle by means of a wooden shaft. The modern day putter heads are made of metal or metal and plastic compositions and invariably the face of the putter head is flat. Accordingly, many of the prior art putter head designs do not necessarily employ the best design features to help the golfer impart the proper feel and accuracy when striking the spherical golf ball with the flat face of the putter head.

Bearing in mind the deficiencies of the prior art putter designs, it is an object of the present invention to provide a new putter head design which employs an arcuate putter face to help the golfer control the force and accuracy imparted to the golf ball during the putting stroke.

Still other objects and advantages of the invention will in part be obvious and will in part be apparent from the specification which follows.

SUMMARY OF THE INVENTION

The above and other objects, which will be apparent to those skilled in art, are achieved in the present invention by providing a golf putter head design which employs an arcuate putter face which conforms substantially to the spherical shape of the golf ball surface. In one embodiment of the invention, the arcuate face of the putter head is the sole surface which contacts the golf ball to propel the same on the path directed by the golfer. In other embodiments of the present invention, the putter head design includes an arcuate face portion which intersects and cooperates with a notched portion which contact the golf ball to propel the same on the path directed by the golfer.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

The following description is provided to enable a person skilled in the art to use the invention and sets for the best modes for carrying out the invention. Various modifications will remain readily apparent to those skilled in the art.

Figure 1:
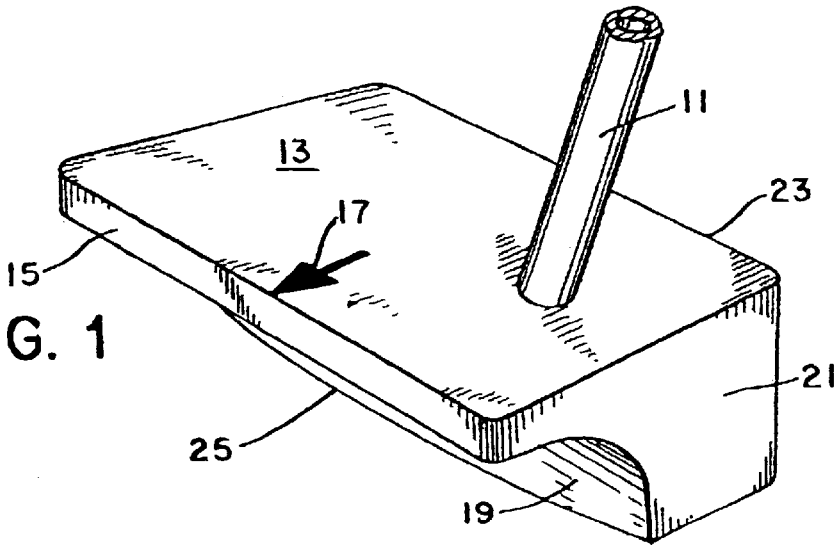
FIG. 1 is a perspective view of a putter head according to one embodiment of the present invention.

In the embodiment show in FIG. 1, the putter shaft 11 is partially removed for clarity. As with conventional and prior art putters the shaft 11 is preferably made of a material such as steel, graphite, wood or the like with appropriate strength and rigidity. In addition to the shaft 11 the putter could include a hosel (not shown) for connection to a putter head 13. In the present illustration of the invention, the putter shaft 11 is connected directly to the putter head 13. Depending upon the preference of the putter manufacturer a hosel could be employed for connection to the putter head. The putter head 13 can be made from a rectangular block of metal, wood, plastic composites and is provided with an upper face 15. The top of the putter head is provided with an alignment marker, or arrow 17 to delineate the midpoint of the putter head. Contiguous with the upper face 15 is an arcuate surface 19 which runs the width of the putter head face and terminates at a side surface 21. The putter head has a rear surface 23 which connects to the side surface 21 and a like side surface opposite the side surface 21. The putter head has a curved sole portion 25 which is customary in most putter head designs so that the edges of the putter head will not cause scuffing of the putting surface or green 27 if the putter is misaligned by the golfer during the putting stroke.

Figure 2:
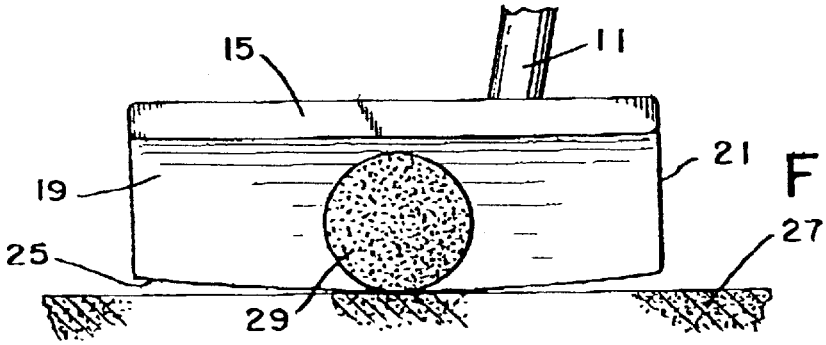
FIG. 2 is a front elevational view of the putter head shown in FIG. 1 and shows a golf ball in position when being struck by the putter head.
Figure 3:
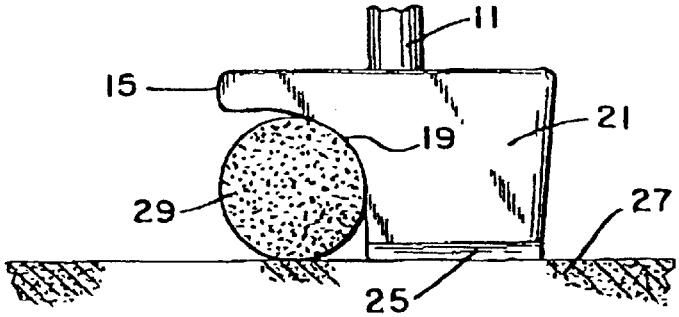
FIG. 3 is a side elevational view of the putter head shown in FIGS. 1 and 2 and shows a golf ball in position when being struck by the putter head.

Referring to FIG. 2, there is shown a golf ball 29 having the diameter of a USGA regulation golf ball, spherical in shape, in position next to the arcuate surface 19 at the center of the putter head face. When the golf ball 29 is contacted by the putter head upon a proper stroke by the golfer, the arcuate surface 19 of the putter face will contact the spherical shape of the golf ball as clearly shown in FIG. 3 because the arcuate surface conforms substantial to the spherical shape of the golf ball. In carrying out such a stroke as illustrated in FIGS. 2 and 3, the golf ball will be propelled in the desired direction intended by the golfer.

Figure 4:
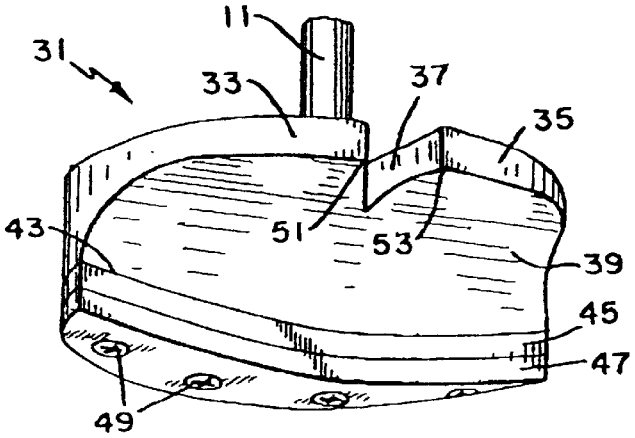
FIG. 4 is a perspective view of alternative putter head according to the invention.
Figure 5:
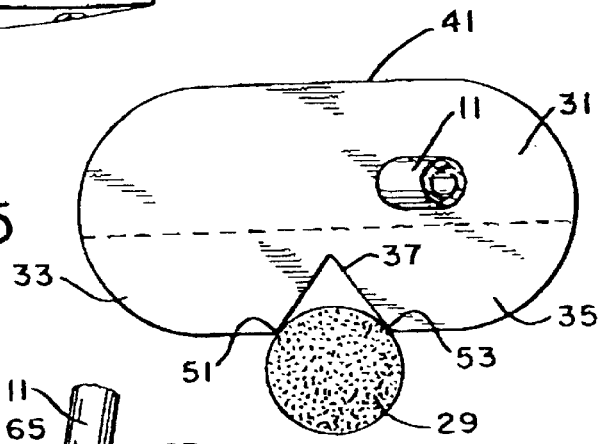
FIG. 5 is a top plan view of the putter head shown in FIG. 4 and shows a golf ball in position when being struck by the putter head.

FIG. 4 shows an alternate embodiment of the invention wherein a putter head generally referred to as 31, is connected to the putter shaft 11 as shown. The embodiment employs a first upper face portion 33 and a second upper face portion 35 which are contiguous to a V-notched portion 37 positioned at the midpoint of the putter head as shown. The upper face portions 33 and 35 are also contiguous to an arcuate surface portion 39 and to a rear surface 41 as clearly shown in FIG. 5. The bottom sole portion 43 is curved and in this embodiment could include (optionally) a plastic laminate 45 to cover the same and a metal sole plate 47 secured by screws or fasteners 49. The intersection of the arcuate surface portion 39 at the juncture of the V-notch with first upper and second upper face portions 33 and 35 form first and second strike portions 51 and 53 which are shown making contact with the golf ball 29 as more clearly shown in FIG. 5.

Figure 6:
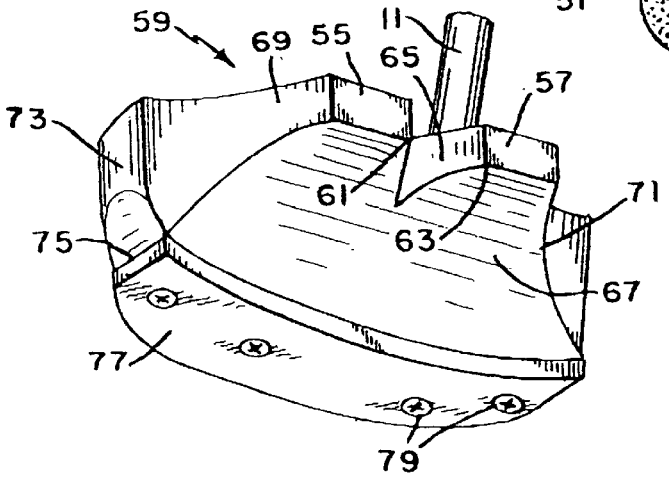
FIG. 6 is a perspective view of still another embodiment of the invention.

FIG. 6 shows still another embodiment of the invention which has a first upper face portion 55 and a second upper face portion 57 on a putter head 59. These upper face portions 55 and 57 contain a first strike portion 61 and a second strike portion 63 formed by the intersection with a V-notched portion 65 (positioned at the midpoint of the putter head) and an arcuate surface portion 67. The face portions 55 and 57 are connected by first and second flange portions 69 and 71 to rear surface 73 in the putter head 59 as clearly shown in FIG. 7. A bottom sole portion 75 is curved and provided with a metal sole plate 77 secured by screws 79.

Figure 8:
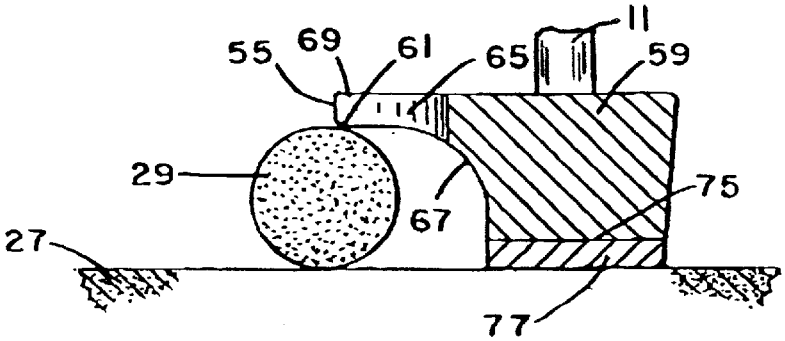
FIG. 8 is cross-sectional view taken along line 8—8 of FIG. 7.
Figure 7:
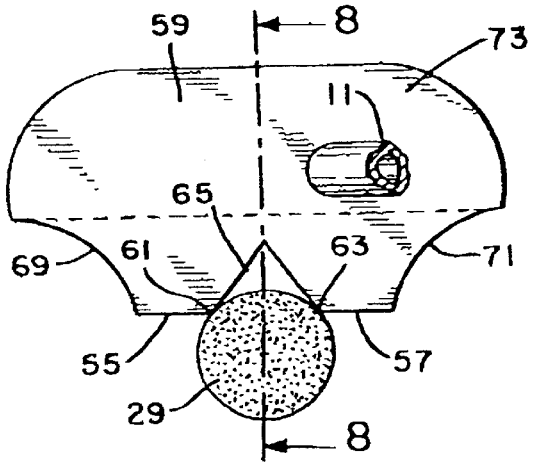
FIG. 7 is top plan view of the putter head shown in FIG. 6 and shows a golf ball in position when being struck by the putter head.

Referring now to FIG. 7, it shows the golf ball 29 in contact with the first and second strike portions 61 and 63 when the golf ball is accurately aligned and struck by the golfer. This is more clearly shown in the cross-sectional view of FIG. 8 taken along line 8—8 of FIG. 7.

When the golfer utilizes a putter with the putter head design shown in FIGS. 1–3, the height of the golf head relative to the height of the golf ball laying on the putting surface is such that only the arcuate surface 19 contacts and propels the ball on its chosen path. When the golfer utilizes a putter with the putter head designs shown in FIGS. 4–8, the height of the golf head relative to the golf ball lying on the putter surface is such that the first and second strike portions contact the golf ball to propel it on its chosen path. Accordingly the designs of the current invention which utilize an arcuate surface at the face of the putter head imparts an improved and accurate putting stroke which differs substantially from the putting stroke imparted with conventional flat putter head designs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as failing within the true scope and spirit of the present invention.

Thus, having described the invention, what is claimed is:

1. A golf club comprising a shaft and a putter head connected to the shaft, said putter head having a top surface with a top front horizontal edge, a bottom surface with a bottom front horizontal edge, rear and opposing edge faces and a vertical arcuate striking face extending the length of the top front horizontal edge and from the bottom front edge to the top front edge so that the top front edge overhangs the bottom front edge by at least the diameter of a USGA regulation golf ball and the height of the vertical arcuate striking face is at least as high as the diameter of the golf ball so that upon a stroke of the club the arcuate face of the club is the sole surface which contacts the golf ball to propel the golf ball on the path of the stroke.

2. The golf club according to claim 1 wherein the vertical arcuate striking face is a portion of a sphere in the shape of a golf ball.

3. The golf club according to claim 1 wherein the top surface has an alignment marker to delineate the midpoint of the putter head.

4. The golf club according to claim 1 wherein the bottom surface is curved.

* * * * *